United States Patent [19]

Uchida

[11] Patent Number: 4,586,202

[45] Date of Patent: May 6, 1986

[54] TOILET SEAT COVER

[75] Inventor: Mitsunobu Uchida, Norcross, Ga.

[73] Assignee: Kabushiki Gaisha Sanko, Japan

[21] Appl. No.: 656,871

[22] Filed: Oct. 2, 1984

[51] Int. Cl.[4] ..... A47K 13/14

[52] U.S. Cl. ..... 4/242

[58] Field of Search ..... 4/234, 237, 242–245

[56] References Cited

U.S. PATENT DOCUMENTS

| | | | |
|---|---|---|---|
| 1,140,814 | 5/1915 | Graves | 4/245 |
| 1,278,381 | 9/1918 | Power | 4/243 |
| 1,635,072 | 7/1927 | DeLuna | 4/243 |
| 2,858,549 | 11/1958 | Carson | 4/242 |
| 3,102,276 | 9/1963 | Warnberg | 4/242 |

FOREIGN PATENT DOCUMENTS

| | | | |
|---|---|---|---|
| 0097133 | 12/1983 | European Pat. Off. | 4/242 |

*Primary Examiner*—Charles E. Phillips

*Attorney, Agent, or Firm*—Darby & Darby

[57] ABSTRACT

A cover for a toilet seat comprising a cover main body and a retainer for attaching the cover main body to the toilet seat. The cover main body is in the form of a short tube of stretchable fabric and has an elastic member attached to the peripheral edge of each open end of the tube. The retainer is a ring having a size intermediate between the sizes of the inner and outer peripheries of the toilet seat and is formed in its outer side surface with a groove for fitting therein the elastic member attached to one end of the cover main body. The cover can be attached to and removed from the toilet seat easily and quickly, can be manufactured without necessitating a cumbersome stitching process and is usable for toilet seats of different sizes or shapes freely.

12 Claims, 14 Drawing Figures

TOILET SEAT COVER

BACKGROUND OF THE INVENTION

1. Field of the Invention

The present invention relates to a cover which is to be attached to toilet seats.

2. Description of the Prior Art

FIG. 10 shows an example of toilet bowl comprising a toilet main body 11, an annular toilet seat 12 positioned on the top of the main body 11 and having inner and outer peripheries which are both oval when seen from above, the toilet seat 12 being hinged at an outer peripheral portion to the main body 11, and a lid 13 positionable over the toilet seat 12 and having a periphery which is oval when seen from above, the lid 13 being hinged at a peripheral portion to the main body 11 along with the toilet seat 12.

Known covers for toilet seats, such as the seat 12 mentioned above, include those disclosed in Japanese Utility Model Publication (examined) No. 52-50574 (1977) and No. 51-522213 (1976).

FIG. 11 shows the toilet seat cover of the former publication. A stretchable strip of knitted fabric or the like having a specified length has its longitudinally opposite ends stitched together to form a short tube 71, which is formed with annular hems 72, 73 along the edges of its open ends. A hard resilient core 74 in the form of a rigid synthetic resin wire (or pipe) and having a length larger than the inner peripheral length of the toilet seat 12 is inserted in the annular hem 72. The core 74 is adapted to form a ring when one end thereof is inserted into a connecting tube at the other end thereof. Thus, the core 74 forms a resilient peripheral edge when inserted into the hem 72 through an insertion hole formed in the hem at a suitable portion thereof and connected into a ring. The annular hem 73 has enclosed therein a stretchable line 75, such as a rubber string, having a smaller length than the hard resilient core 74 when left intact and unstretched. The line 75 forms a stretchable peripheral edge.

The toilet seat cover thus formed is provided over a toilet seat 12 as seen in FIG. 12. First, the resilient peripheral edge having the hard core 74 enclosed therein is placed in contact with the rear side of the toilet seat 12, as positioned toward its inner periphery. On the other hand, the stretchable peripheral edge having the stretchable line 75 enclosed therein is inserted upwardly through the opening of the toilet seat 12, stretched over the upper surface of the seat 12 and folded back onto the rear side of the rim of the seat 12. Consequently both open-end edges of the short fabric tube 71 are held to the rear side of the toilet seat 12 by being thereby restrained, with the intermediate portion of the tube 71 covering the upper surface of the seat 12, whereby the cover is attached to the seat 12.

FIG. 13 shows the toilet seat cover of the latter publication. A short tube 91 having a width larger than the width of the seat surface of a toilet seat 12 is obtained by cutting a tubular knitted fabric. Both the opening edges of the tube 91 are folded back over the entire circumference and stitched down to form hollow annular hems 92, 93 of suitable width. A rigid synthetic resin wire (or pipe) inserted in the hollow annular hem 92 through a hole at a hem portion is provided at its one end with a connecting tube into which the other end of the wire is inserted. The wire therefore forms a hard resilient core ring 94 having a circumferential length larger than the inner peripheral length of the toilet seat 12. The other hollow annular hem 93 has enclosed therein a string 95, such as a rubber string, inserted into the hem through a hole and having opposite ends extending outward from the insertion hole.

The cover thus formed is fitted over the toilet seat 12 as shown in FIG. 14. First, the opening edge having the hard resilient core ring 94 enclosed therein is placed in contact with the rear side of the seat 12, as positioned toward the inner periphery thereof. The other opening edge having the string 95 inserted therethrough is upwardly passed through the opening of the seat 12. Next, while stretching the short tube 91 over the seat 12 widthwise of its seat surface, the latter opening edge is folded back onto the rear side of the rim of the toilet seat 12. The ends of the string 95 are then pulled and ties together so that the circumferential length of the string 95 will be shorter than the outer peripheral length of the seat 12. Consequently both the opening edges of the short fabric tube 91 are held to the rear side of the toilet seat 12 by being restrained by the hard resilient core ring 94 and the string 95. The cover is fitted over the toilet seat 12, with its intermediate portion covering the upper surface of the seat 12.

The conventional toilet seat covers described are generally convenient to attach and give a fair comfort to the user. With the former toilet seat cover, however, the annular hems 72, 73 having insertion holes for accommodating the resilient core 74 and the stretchable line 75 must be formed at the opening edges of the short fabric tube 71, while the short fabric tube 91 of the latter cover needs to be similarly provided with the hollow annular hems 92, 93 having insertion holes for enclosing and inserting the core ring 94 and the string 95. These hems require a cumbersome stitching process including not a few steps. Moverover, at least the core 74 and the core ring 94 must be removed every time these covers are to be washed. To remove the core 74 or the core ring 94, there arises the need to withdraw one end of the rigid synthetic resin wire from the connecting tube and pull out the wire end or the tube end from the hem 72 or 92 after guiding the end to the insertion hole. Further when attaching the core 74 or the core ring 94 to the short fabric tube 71 or 91 by inserting the resin wire end into the hem 72 or 92 through the insertion hole, the wire end is likely to get caught in the hem. Accordingly the core 74 or the core ring 94 is very cumbersome to attach to or remove from the short fabric tube 71 or 91. The conventional covers have another drawback. Since the core 74 or the core ring 94 has a circumferential length which is in conformity with the inner peripheral length of the oval toilet seat 12, the cover is not fittable to U-shaped toilet seats. Thus, the conventional covers are not universally usable for toilet seats of different sizes or specifications.

OBJECTS OF THE INVENTION

A first object of the present invention is to provide a toilet seat cover which, unlike conventional ones, does not require annular hems or the like having insertion holes.

A second object of the invention is to provide a toilet seat cover which can be manufactured by an efficient stitching process.

A third object of the invention is to provide a toilet seat cover comprising a cover main body which is attachable to and removable from a retainer quickly and easily.

A fourth object of the invention is to provide a toilet seat cover which can be attached to toilet seats of different sizes and configurations.

The above and further objects and features of the invention will more fully be apparent from the following detailed description with reference to the accompanying drawings.

DETAILED DESCRIPTION OF THE INVENTION

Figure 2:
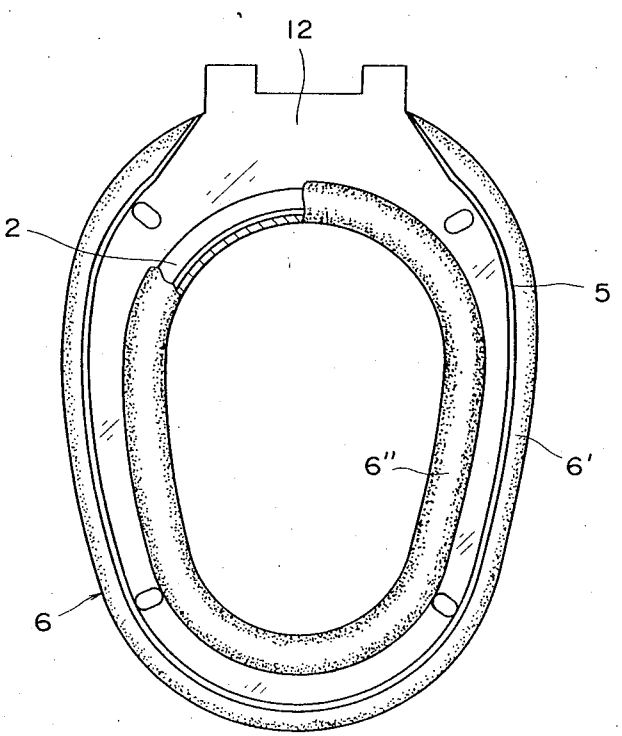
FIG. 2 is a rear view partly broken away and showing the same.
Figure 1:
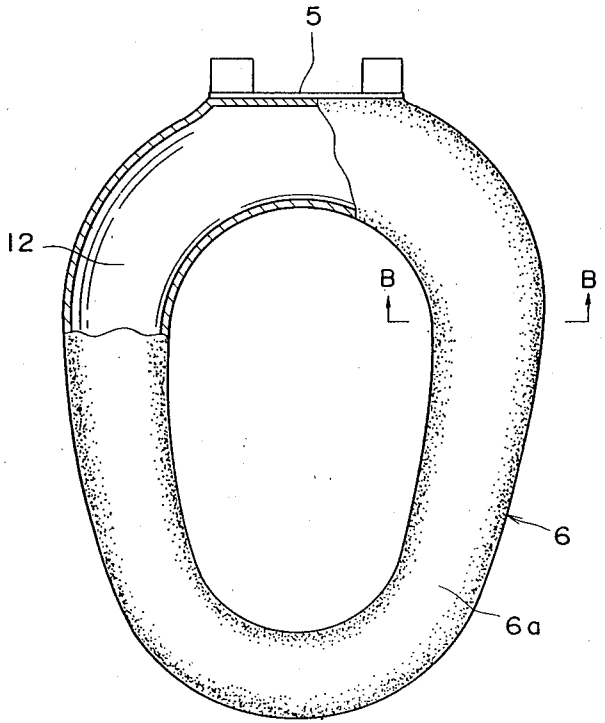
FIG. 1 is a plan view partly broken away and showing an embodiment of the invention as attached to a toilet seat.

A toilet seat cover of the invention will be described below with reference to FIGS. 1 to 9 showing the cover.

A toilet seat cover main body 6 is in the form of a short tube 6*a* of tubular knitted fabric of spandex having stretchability and a pile surface. The tube 6*a* has opposite opening edges 6′ and 6″ which are respectively wrapped up with flat elastic members 4 and 5, such as rubber strips, by binding. Of the two ends of each of the elastic members 4, 5, one end is wrapped around and directly stitched to the opening edge 6′(6″) of the short tube 6*a*, while the other end portion is lapped over the above-mentioned one end by a specified length and stitched down. The remainder of the other end portion is folded in two widthwise thereof, and the opposed side edges of the folded extremity are directly stitched together. The extremity is folded inwardly of the short tube 6*a* across said one end and is stitched down to form a small protuberance 5*a* (4*a*).

When free of any tension, the short fabric tube 6*a* is about 68 cm in circumferential length, about 20 cm in diameter and about 12 cm in width. It is stretchable to about 100 cm in circumferential length, about 28 cm in diameter and about 27 cm in width. The elastic members 4, 5, when not tensioned, have a width of about 1.4 cm (with the front and rear side widths combined) and a circumferential length of about 65 cm which is slightly shorter than the circumferential length, about 68 cm, of the tube 6*a* in its untensioned state. The elastic members are stretchable to a circumferential length of about 100 cm and have a greater elastic force than the short tube 6*a*. The tube 6*a*, which is made of a tubular knitted fabric as already stated, may alternatively be formed by stitching a strip of fabric end-to-end. Further instead of stitching the elastic members 4, 5, such as rubber strips, directly to the opening peripheral edges of the short tube 6*a*, each elastic member may be attached to the tube 6*a* by folding back each opening edge over a suitable width to form a tubular portion and inserting the elastic member into the tubular portion. With the cover main body 6 wherein the elastic members 4, 5 are stitched to the short tube 6*a*, both opening edges of the tube 6*a* in untensioned state, unlike the other portion thereof, are slightly gathered to a circumferential length equal to that of the elastic member 4, 5 and slightly smaller than the inner peripheral length of the toilet seat 12 for which the cover is used.

With reference to FIGS. 4, 5, 6 and 8, a retainer 2 is made of rigid synthetic resin and is a ring having oval inner and outer peripheries which are slightly larger than, and have the same shape as, the inner periphery of the toilet seat 12 when seen from above. An annular groove 1 having a depth of about 1 cm is formed in the outer periphery of the retainer 2 over the entire circumference. The inner and outer peripheral lengths of the retainer 2 are larger than the inner peripheral length of the toilet seat 12 but are smaller than the outer peripheral length of the seat 12. When placed on the rear side of the toilet seat 12 concentrically therewith, the retainer 2 is positioned slightly inward from the midpoint of width of the seat surface. While the retainer 2 itself is oval in conformity with the shape of the seat 12 when seen from above as stated above, the retainer 2 can be polygonal or of any other shape insofar as it is larger than the inner periphery of the seat 12 but smaller than the outer periphery thereof. The retainer 2 has a larger dimension in the horizontal direction than in the vertical direction in cross section as seen on the left or right side of FIG. 6. (In the following description and appended claims, the term "cross section" means such a cross section of a constituent portion of the retainer and does not refer to the overall cross section of the retainer.) The retainer 2 is U-shaped in cross section, and the groove 1 is formed in its outer peripheral surface centrally thereof and has a width slightly larger than the thickness of the elastic member 4 or 5 attached to the cover main body 6. The opposed side walls defining the groove 1 have a small thickness. The outer peripheral edges of the side walls are adapted to retainer the elastic member 4 or 5 therein against slipping off even when the cover main body 6 is pulled with the elastic member 4 or 5 fitted in the groove 1. The retainer 2 or the groove 1 is not limited to the above-mentioned form in cross section but can be C-shaped or -shaped in cross section. The retainer 2 may be made of a material having suitable hardness, such as a metal.

Figure 9:
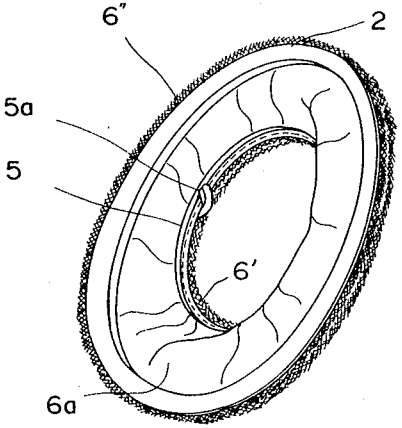
FIG. 9 is a perspective view showing the cover main body and the retainer as joined together.
Figure 5:
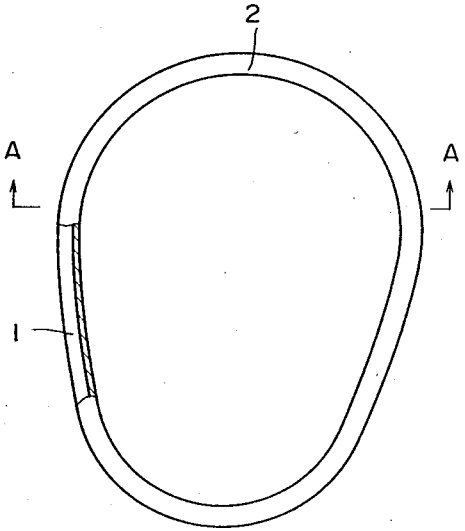
FIG. 5 is a plan view partly broken away and showing the retainer.
Figure 6:
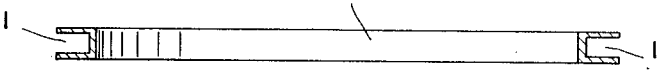
FIG. 6 is an enlarged view in section taken along the line A—A in FIG. 5.

The cover main body 6 and the retainer 2 thus formed are joined together by fitting one of the elastic members 4, 5 on the main body 6 into the groove 1 of the retainer 2. For example, the protuberant portion 4*a* of the member 4 attached to the opening edge 6″ of the cover main body 6 is forced into the groove 1 of the retainer 2 first, whereby the protuberant portion 4*a*, which has a slightly larger thickness than the other portion of the elastic member 4, is relatively tightly confined in the groove 1 and retained therein by the memory of the elastic member 4, 5. Subsequently the opening edge 6'' of the cover member 6 is slightly stretched from portion to portion circumferentially away from the protuberant portion 4*a* as positioned along the groove 1, whereby the elastic member 4, which is reduced in thickness, can be smoothly fitted into the groove 1 over the entire circumference. FIG. 9 shows the cover main body 6 and the retainer as joined together. The elastic member 4 on the cover main body 6 fitted in the groove 1 is prevented from slipping off the grooved retainer 2 by its own contracting force. To remove the cover main body 6 from the retainer 2, the short fabric tube 6*a* of the cover main body 6 is pulled to partly withdraw the elastic member 4 from the groove 1. This releases the elastic member 4 from the groove 1 over the entire circumference by virtue of the contraction of the elastic member 4 to remove the main body 6 from the retainer 2.

Figure 4:
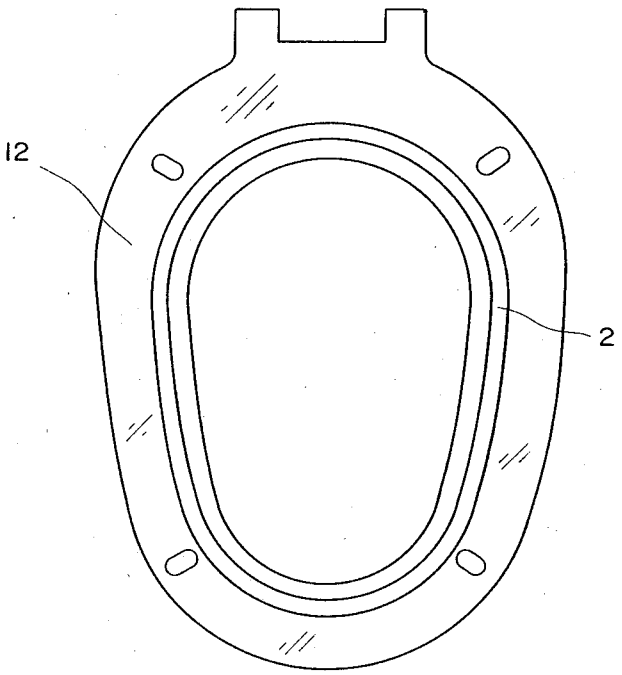
FIG. 4 is a rear view showing a retainer included in the embodiment and in contact with the rear side of the toilet seat.
Figure 3:
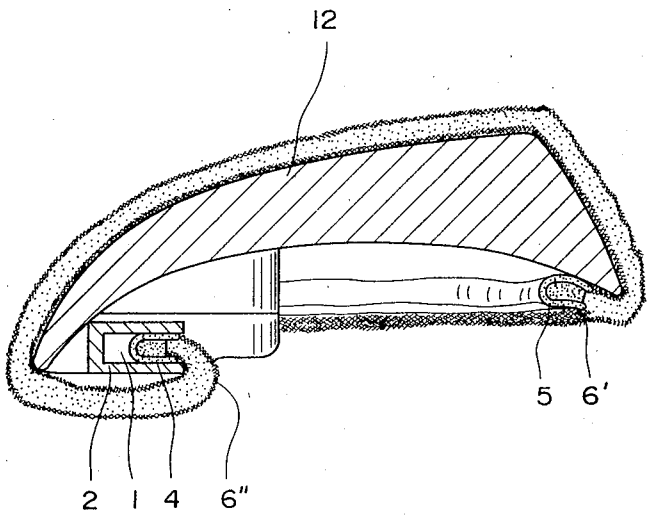
FIG. 3 is an enlarged view in section taken along the line B—B in FIG. 1.
Figure 8:
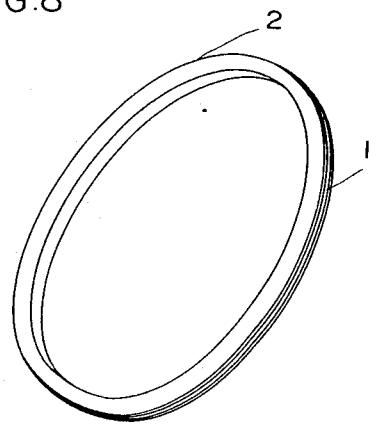
FIG. 8 is a perspective view showing the retainer.
Figure 7:
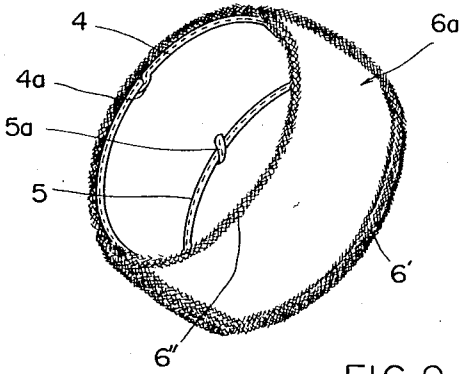
FIG. 7 is a perspective view showing a cover main body constituting the embodiment.

The toilet seat cover in the form of the assembly of cover main body 6 and retainer 2 is attached to the toilet seat 12 in the following manner. First, the exposed surface of the retainer 2 joined to the main body 6, i.e. the surface shown in FIG. 9, is placed into contact with the rear side of the toilet seat 12 generally concentrically with the seat 12 as seen in FIGS. 2 and 4. Next, the other opening edge 6' of the cover main body 6 is passed through the opening of the toilet seat 12 to the front side thereof while turning the cover main body 6 inside out. The opening edge 6' of the main body 6 is stretched outward radially of the seat and the rear surface of the cover main body 6 is passed over the front surface of the seat 12 to the rear side of the seat beyond the rim thereof, whereupon the opening edge 6' is held to the rear side of the toilet seat 12 along its rim by being restrained by the contraction of the elastic member 5. In this state, the cover main body 6, especially the short fabric tube 6*a* thereof, is held tensely stretched circumferentially and widthwise thereof. However, the cover main body 6 is retained on the toiled seat 12 because the opening edges 6'', 6' are held in the groove 1 of the retainer and to the rear side of the seat 12 adjacent its rim, respectively, by being restrained by the elastic members 4, 5.

The cover is removable from the toilet seat 12 in the following manner. A portion of the opening edge 6' held to the rear side of the seat 12 by the elastic member 5 is pulled sidewise outwardly of the seat 12 and further pulled toward the upper side of the seat 12 beyond the rim thereof, whereupon the contracting force of the elastic member 5 itself acts to pull the entire opening edge 6' toward the upper side of the toilet seat 12. Thus, the cover is removed from the toilet seat 12.

Figure 14:
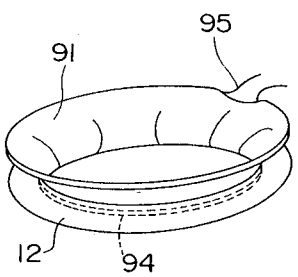
FIG. 14 is a perspective view showing how to attach the conventional cover of FIG. 13 to a toilet seat.
Figure 11:
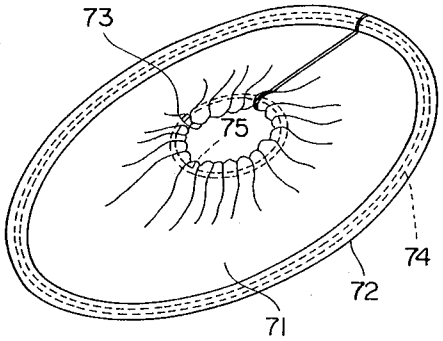
FIG. 11 is a perspective view showing a conventional cover.
Figure 13:
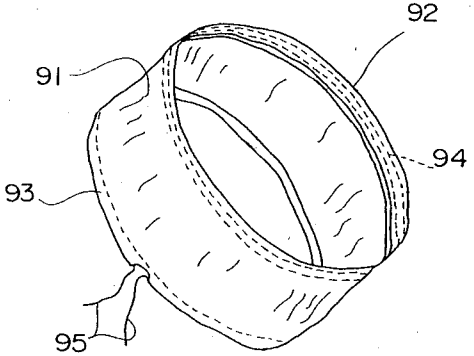
FIG. 13 is a perspective view showing another conventional cover.
Figure 12:
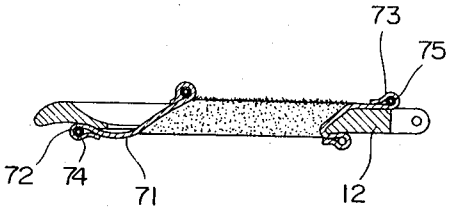
FIG. 12 is a sectional view showing how to attach the cover to a toilet seat.
Figure 10:
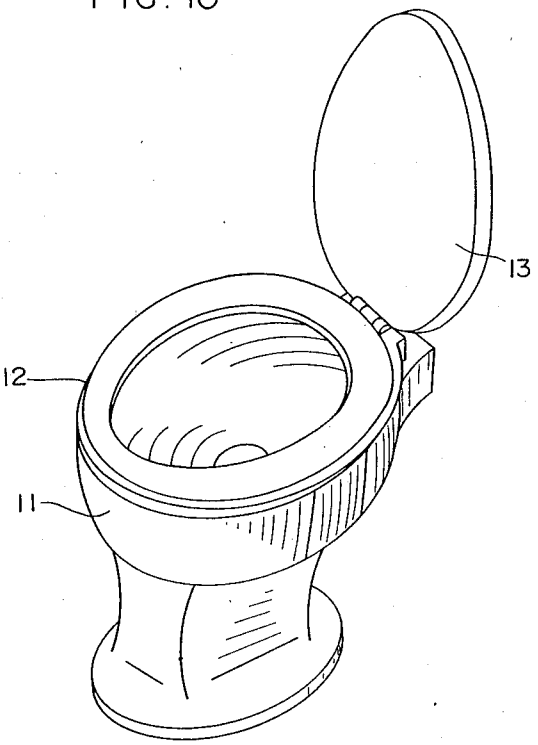
FIG. 10 is a perspective view showing a toilet bowl with its lid opened.

The cover of the present invention comprises a cover main body 6 having elastic members 4, 5 stitched to its opposite opening edges 6'', 6', respectively, and a retainer 2 in the form of a ring larger than the inner periphery of the toilet seat but smaller than the outer periphery thereof, the retainer 2 having a groove 1 for removably holding therein the elastic member 4 or 5 at the opening edge 6'' or 6' of the cover main body 6. The cover main body 6 can be joined to or detached from the retainer 2 with ease quickly by fitting one of the elastic members 4, 5 into the groove 1 of the retainer 2 or disengaging the member from the groove. The toilet seat cover of the present invention does not require the stitching or sewing work needed for the conventional seat shown in FIGS. 11 and 12 to form the annular hems 72, 73 having insertion holes at the opening edges of the short tube 71 for accommodating the resilient core 74 and the stretchable line 75, or for the conventional seat of FIGS. 13 and 14 to form the hollow annular hems 92,93 having insertion holes at the opening edges of the short tube 91 for enclosing the core ring 94 and the string 95. Accordingly the present seat cover can be produced by a greatly reduced number of steps. Furthermore, the present cover does not in any way require the cumbersome procedure of inserting the core 74 and the line 75 into the annular hems 72, 73 or of inserting the ring 94 and the string 95 into the hollow annular hems 92, 93.

The elastic member 4 on the cover main body 6 is fitted in the outer peripheral groove 1 of the retainer 2 and held therein by being restrained by its own contracting force. When the cover main body 6 is attached to the toilet seat 12, the portion of the short tube 6*a* adjacent to the elastic member 4 is wrapped around the peripheral edge of the retainer 2 and the rim of the toilet seat 12, with the result that even if the short tube 6*a* is subjected to great tension, the elastic member 4 will not slip off the groove 1 but effectively holds the cover main body 6 joined to the retainer 2. The retainer 2 itself may be so sized that its outer periphery conforms to the outer periphery of a relatively small toilet seat 12, with its inner periphery in conformity with the inner periphery of a relatively large toilet seat 12. The cover is then usable for various toilet seats of different sizes and specifications. Moreover either one of the elastic members 4, 5 on the cover main body 6 may be fitted in the groove 1 of the retainer 2, while the short fabric tube 6*a* per se is also usable with its inside out. Thus the present cover is universally usable with increased freedom.

Although the present invention has been described above as embodied for use with oval toilet seats, the retainer 2, which is made of a hard material, is so positionable as to interconnect the opposed ends of a U-shaped toilet seat when used therefor. Accordingly the present cover is usable for toilet seats of different types including oval seats and U-shaped seats. Further because the seat is usable for a wider variety of toilet seats which are different in size or specifications as already mentioned, the number of kinds of toilet seat covers to be manufactured commercially can be reduced for mass production. The present invention has therefore overcome the drawback heretofore experienced that different covers must be produced for toilet seats of different types or sizes.

According to the invention described above, the cover main body can be attached to or removed from the retainer easily and quickly, while the seat cover is universally usable with increased freedom and can be manufactured in large quantities at a reduced cost. Thus, the present invention has various outstanding advantages.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within meets and bounds of the claims, or equivalence of such meets and bounds thereof are therefore intended to be embraced by the claims.

What is claimed is:

1. A cover assembly for a toilet seat, said seat having an inner periphery, a sitting surface and an underside, said cover assembly comprising:

a cover main body including a short tube of stretchable fabric having open ends, an elastic member provided at the edge of each open end thereof, a retainer in the form of a ring larger than the inner periphery of the toilet seat and smaller than the outer periphery thereof, said retainer having in its outer peripheral side surface a groove for removable fitting therein the elastic member provided at the edge of one open end of said cover main body, wherein, the thickness of at least one of said elastic members, at its respective edge, being related to the height of said groove, such that upon insertion thereof into said groove the memory of said elastic member will sustain said insertion while the other edge passes over said toilet seat sitting surface for attachment to said underside.

2. A toilet seat cover assembly as set forth in claim 1 wherein said retainer has a channel cross section with said groove in its outer side surface.

3. A toilet seat cover assembly as set forth in claim 1 wherein said retainer is C-shaped in cross section with the groove in its outer side surface.

4. A toilet seat cover assembly as set forth in claim 1 wherein said retainer has a hollow quadrilateral cross section having its outer side cut out at its midportion, said retainer being thereby formed with said groove in its outer side surface.

5. A toilet seat cover assembly as set forth in claim 1 wherein said retainer is made of a rigid synthetic resin.

6. A toilet seat cover assembly as set forth in claim 1 wherein said retainer is made of a metal.

7. A toilet seat cover assembly as set forth in claim 1 wherein said retainer has an oval plane view.

8. A toilet seat cover assembly as set forth in claim 1 wherein said retainer has a polygonal plane view.

9. A toilet seat cover assembly as set forth in claim 1 wherein said elastic member is stitched directly to the edge of each open end of the cover main body respectively.

10. A toilet seat cover assembly as set forth in claim 1 wherein said edge of each open end of said cover main body is folded back over a specified width to form a tubular portion, and said elastic member is inserted through said tubular portion respectively.

11. A toilet seat cover assembly as set forth in claim 1 wherein the cover main body is made of a tubular knitted fabric.

12. A toilet seat cover assembly as set forth in claim 1 wherein said cover main body is formed by stitching a strip of fabric to itself end-to-end.

* * * * *